US006006401A

United States Patent [19]

Jailor et al.

[11] Patent Number: 6,006,401

[45] Date of Patent: Dec. 28, 1999

[54] VACUUM CLEANER HAVING A HANDLE RELEASE THEREON

[75] Inventors: John J. Jailor, Rockford; Steven K. Meek; Jeffrey A. Hall, both of Grand Rapids, all of Mich.; Scott R. Graham, Kewaskum; William H. Frederick, West Bend, both of Wis.

[73] Assignee: BISSELL Homecare, Inc., Grand Rapids, Mich.

[21] Appl. No.: 09/012,046

[22] Filed: Jan. 22, 1998

Related U.S. Application Data

[60] Provisional application No. 60/035,870, Jan. 22, 1997.

[51] Int. Cl.[6] ..... A47L 9/32

[52] U.S. Cl. ..... 15/361; 15/351; 15/410; 15/411

[58] Field of Search ..... 15/361, 354, 410, 15/411, 351

[56] References Cited

U.S. PATENT DOCUMENTS

| | | |
|---|---|---|
| 1,953,944 | 4/1934 | Becker . |
| 1,968,238 | 7/1934 | Zabriskie . |
| 2,039,861 | 5/1936 | Watts . |
| 2,525,282 | 10/1950 | Brace . |
| 2,684,271 | 7/1954 | Brace . |
| 2,881,465 | 4/1959 | Duff . |
| 3,031,710 | 5/1962 | Huening, Jr. . |
| 3,199,138 | 8/1965 | Nordeen . |
| 3,217,351 | 11/1965 | Hayba . |
| 3,291,540 | 12/1966 | Doersam . |
| 3,512,207 | 5/1970 | Ettridge . |
| 3,618,687 | 11/1971 | Ripple et al. . |
| 3,683,449 | 8/1972 | Nordeen . |
| 3,932,912 | 1/1976 | Johnson . |
| 4,129,920 | 12/1978 | Evans et al. . |
| 4,245,371 | 1/1981 | Satterfield . |
| 4,423,534 | 1/1984 | Lyman et al. . |
| 4,670,937 | 6/1987 | Sumerau et al. . |
| 5,218,734 | 6/1993 | Sacks . |
| 5,551,120 | 9/1996 | Cipolla et al. . |

FOREIGN PATENT DOCUMENTS

| | | |
|---|---|---|
| 598972 | 5/1945 | United Kingdom . |

*Primary Examiner*—William H. Beisner

*Attorney, Agent, or Firm*—Rader, Fishman, Grauer & McGarry, an office of Rader, Fishman & Grauer PLLC

[57] ABSTRACT

An upright vacuum cleaner is provided which has a handle pivotally mounted to a foot. The foot has a releasable mechanism pivotally mounted thereto. The releasable mechanism and the handle are provided with abutting protrusions and recesses which can abut one another to retain the handle in an upright storage position, in an angularly disposed position for normal use and a generally horizontal position. The releasable mechanism preferably comprises a foot pedal which has an integral arm spring extending angularly therefrom and biased against the foot so that the protrusion and/or recess on the foot pedal is urged within a corresponding recess and/or protrusion on the handle.

18 Claims, 9 Drawing Sheets

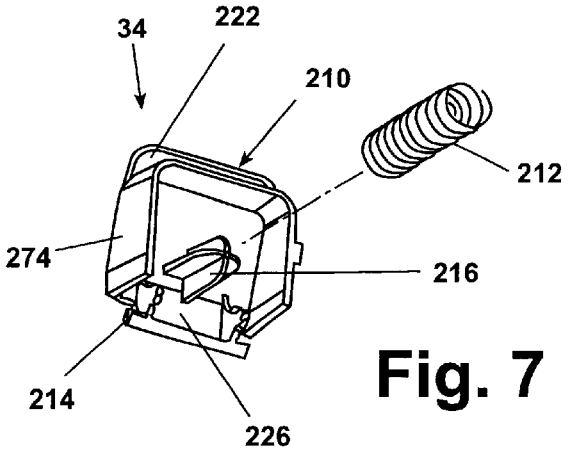
Fig. 7
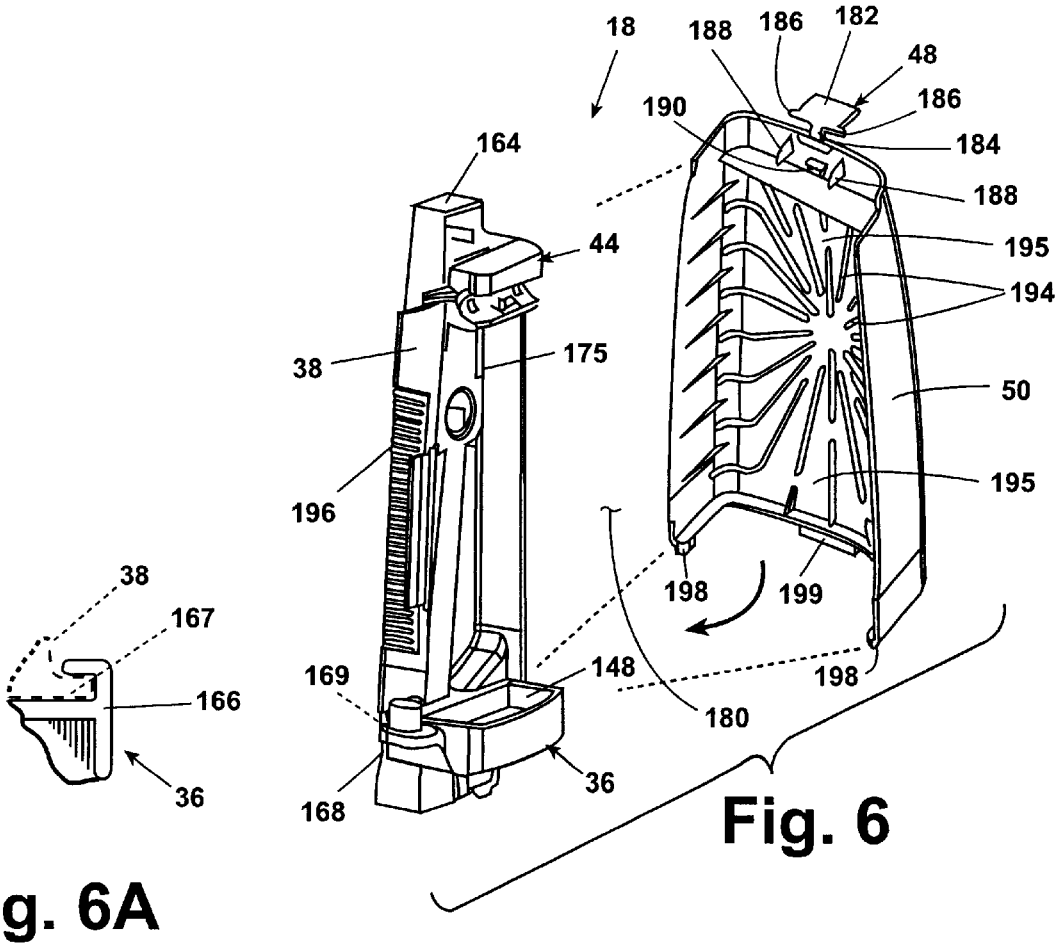
Fig. 6
Fig. 6A

VACUUM CLEANER HAVING A HANDLE RELEASE THEREON

CROSS REFERENCE TO RELATED APPLICATION

This application claims the benefit of U.S. Provisional Application No. 60/035,870, filed Jan. 22, 1997.

BACKGROUND OF THE INVENTION

1. Field of the Invention

The invention relates to a vacuum cleaner, and more particularly, to a vacuum cleaner having a mechanism for releasably retaining a handle portion thereon in various positions relative to a vertical, upright position.

2. Description of the Related Art

Vacuum cleaners are often provided with a handle pivotally mounted to a wheeled foot having a nozzle portion thereon. The handle allows a user to push the foot across a floor surface for cleaning whereby debris collected by the nozzle is collected in a filter bag carried on the vacuum cleaner. A pedal is typically provided on the foot which engages a series of protrusions on the handle for releasably engaging the handle in a series of angular positions relative to a vertical upright position. For example, the pedal is typically adapted to retain the handle portion in an upright position for storage, an angular position for normal use and a generally horizontal position for pushing the foot underneath an object, such as a piece of furniture. Examples of these types of retaining mechanisms are shown in U.S. Pat. Nos. 4,423,534 (Lyman et al.) issued Jan. 3, 1984, 3,683,449 (Nordeen) issued Aug. 15, 1972, 3,932,912 (Johnson) issued Jan. 20, 1976, and 3,199,138 (Nordeen) issued Aug. 10, 1965.

SUMMARY OF THE INVENTION

The invention relates to a vacuum cleaner comprising a foot, a handle pivotally mounted to the foot, a locking assembly for releasably locking the handle in an upright position, the locking assembly including a foot pedal pivotally mounted to the base for movement between a locked position and an unlocked position and having one of a protrusion and a recess and the handle having the other of the protrusion and the recess for selectively locking the handle in the upright position, the foot pedal having an upper surface for actuation by a user, an axle through which the foot pedal is pivotally mounted to the base, and a spring with a proximal end integral with the foot pedal and having a distal end bearing against the base for biasing the foot pedal into the locking position.

Specifically, the invention relates to improvements for the locking assembly including mounting the proximal end of the spring adjacent to the axle. In one embodiment, the locking assembly comprises a slotted circular retainer including a gap between a pair of arcuate arms on the base for mounting the axle and the axle has a pair of flat surfaces adapted to fit through the gap for mounting the axle to the circular retainer. Preferably, the axle further comprises a pair of arcuate surfaces connecting the flat surfaces for journaling the axle within the slotted circular retainer. The spring can be provided with a longitudinal axis which is generally aligned with an axis between the axis of rotation of the axle and the upper surface of the foot pedal. The foot pedal is preferably integrally molded in one piece. The foot pedal further comprises a pair of side walls and the axle extends between the side walls. The side walls can each have an exterior surface wherein at least one of the exterior surfaces mounts the spring.

BRIEF DESCRIPTION OF THE DRAWINGS

The invention will now be described with reference to the drawings wherein:

FIG. 6 is a perspective exploded view of the bag housing of the upright vacuum cleaner of FIGS. 1–5, showing the interior of the bag housing and assembly thereof, FIG. 6A is a fragmentary cross-sectional view of the vacuum cleaner of FIGS. 1–6, taken along lines 6A—6A of FIG. 4;

FIG. 7 is a perspective view of a power switch pedal and spring used in the upright vacuum cleaner of FIGS. 1–6;

DESCRIPTION OF THE PREFERRED EMBODIMENTS

Figure 1:
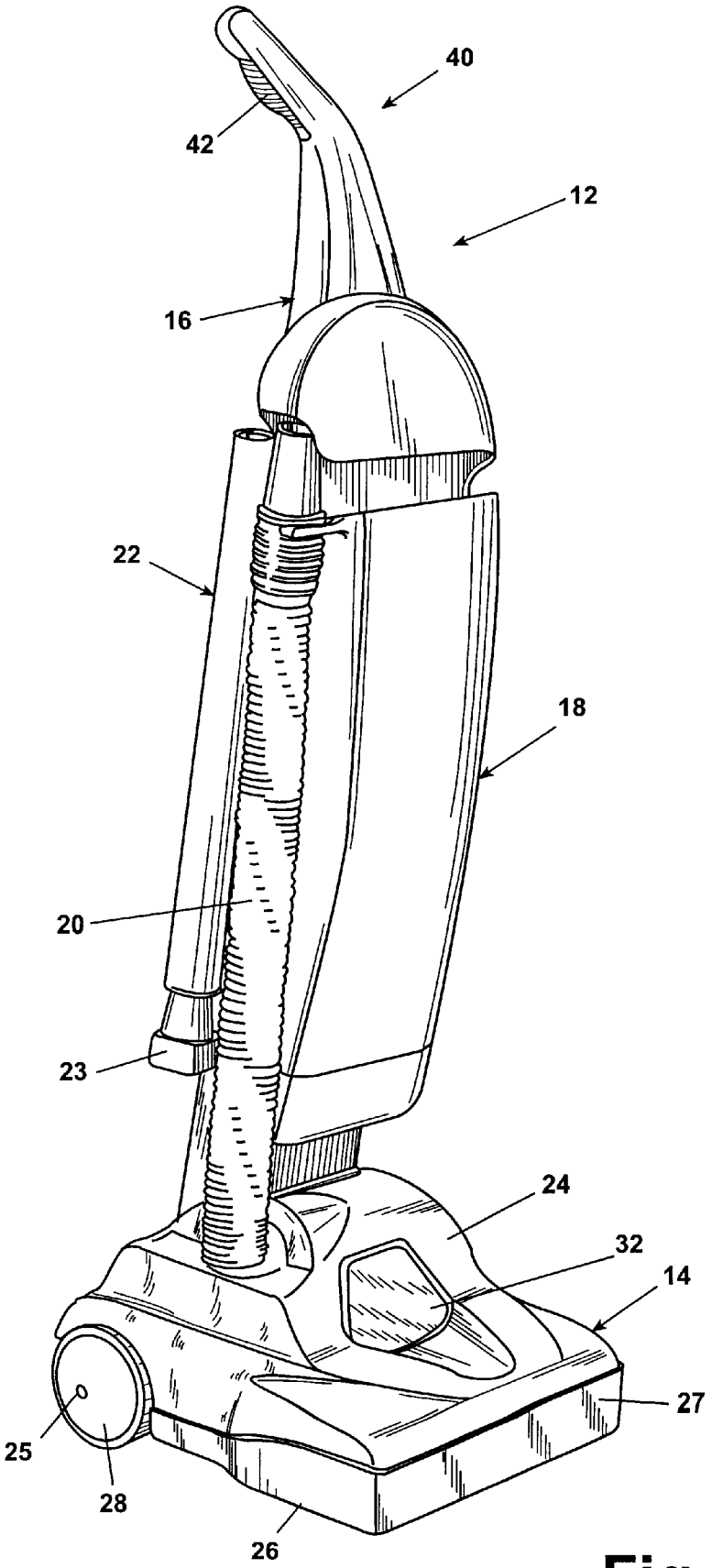
FIG. 1 is a front perspective view of an upright vacuum cleaner according to the invention.
Figure 2:
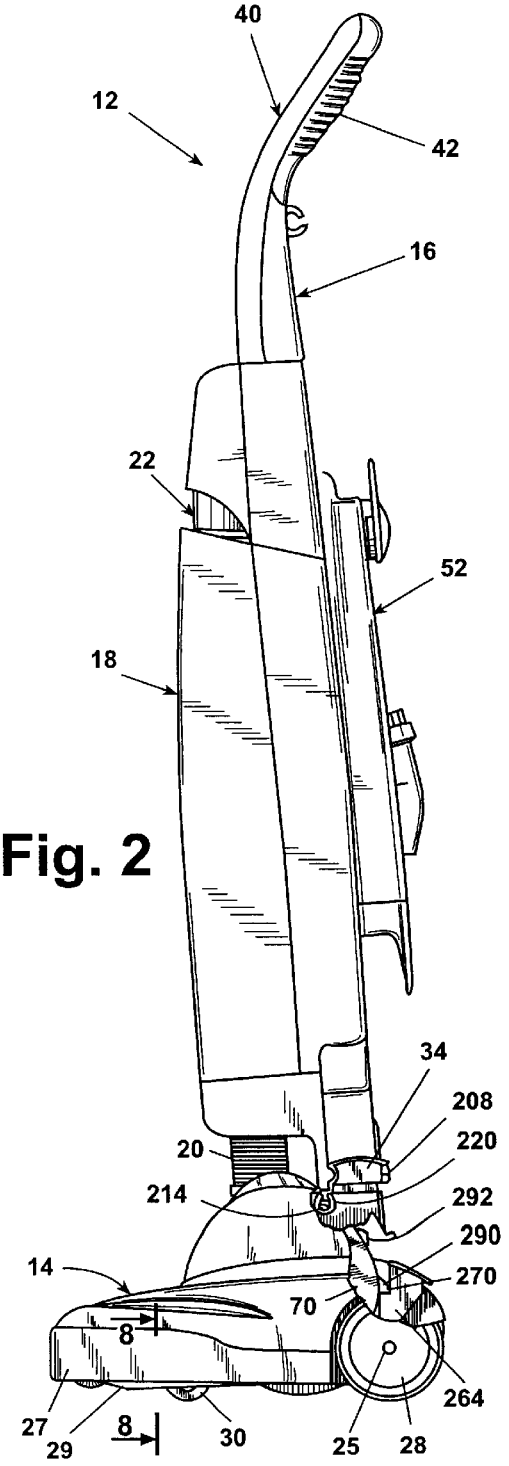
FIG. 2 is a side elevational view of the upright vacuum cleaner of FIG. 1.

Referring now to the drawings and to FIGS. 1–4 in particular, an upright vacuum cleaner 12 according to the invention is shown. The vacuum cleaner 12 comprises a floor engaging foot 14, a handle assembly 16 pivotally mounted to and extending upwardly from the foot 14, a bag housing 18 provided on the handle assembly 16 and a flexible hose 20 extending upwardly from the foot 14. A rigid accessory wand 22 is provided on a support member 23 formed on the handle assembly 16. The wand 22 can be removed from the support member 23 and connected to the flexible hose 20 for above-the-floor cleaning operations.

Alternatively, the foot 14 can be pushed along the floor for traditional on-the-floor cleaning.

Figure 4:
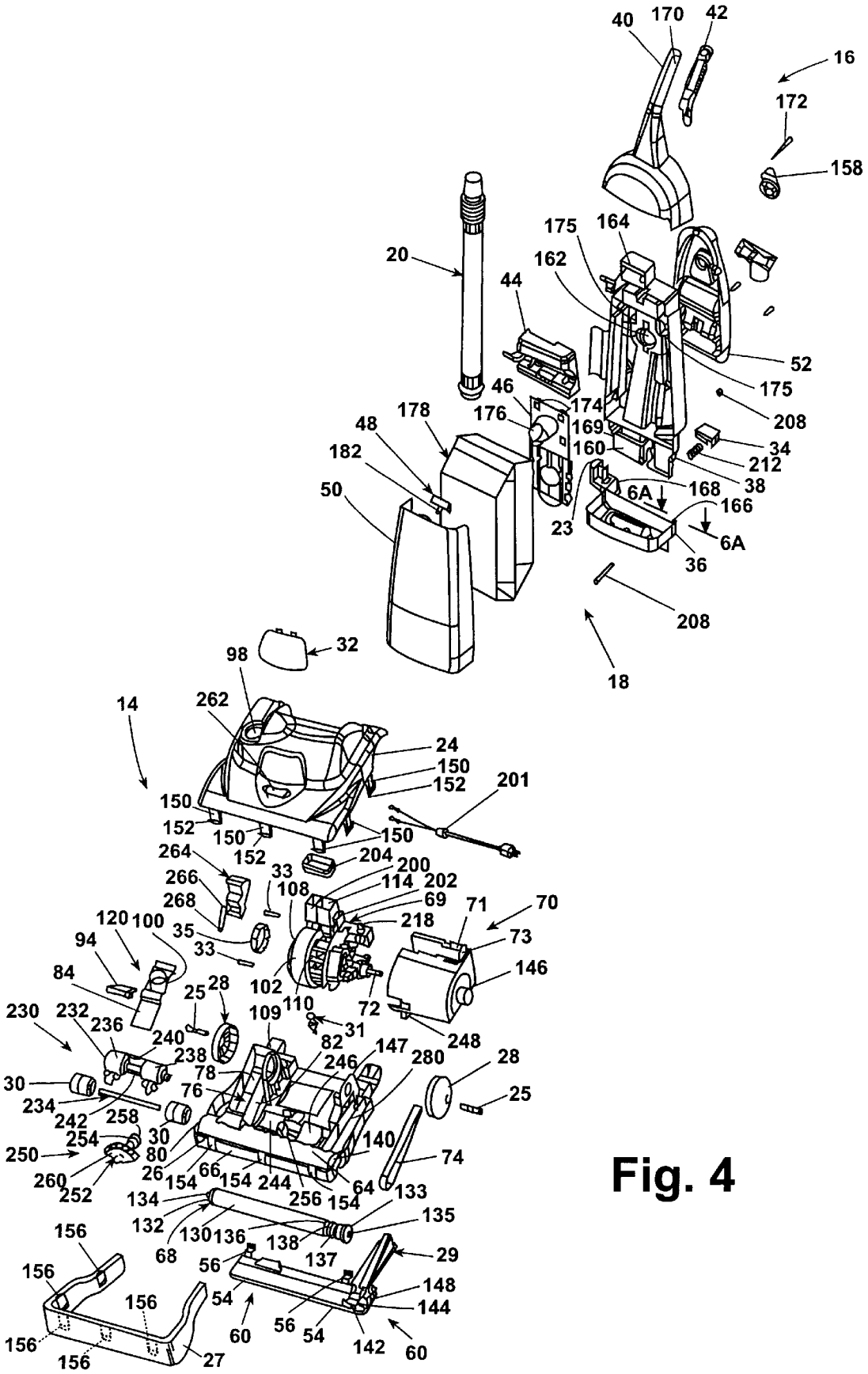
FIG. 4 is an exploded view of the upright vacuum clearer of FIG. 1.
Figure 9:
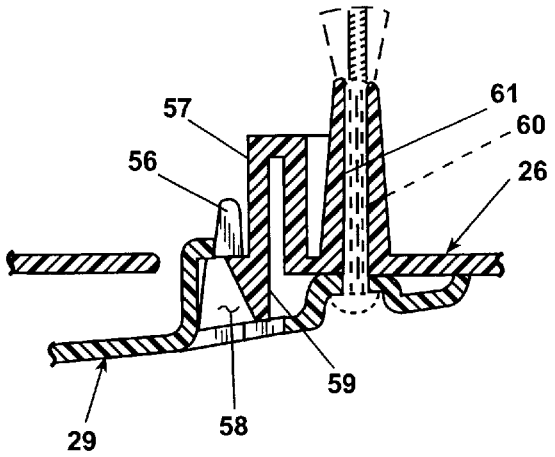
FIG. 9 is a fragmentary cross-sectional view of the vacuum cleaner of FIGS. 1–6, taken along lines 9—9 of FIG. 3.

The foot 14 comprises a cover 24 which is mounted to a base pan 26, a pair of rear wheels 28 supported by pins 25 are provided on the base pan 25 for rollably supporting the rear of the vacuum cleaner 12 and a pair of lift wheels 30 are provided at a central portion of the base pan 26 and adapted to lift the front of the foot 14 away from the floor when the handle 16 is moved to an upright position to prevent a rotating brush roll 68 from damaging the carpet and to provide a mechanism for manually adjusting the operating height of the brush roll 68. The base pan 26 includes a bumper 27 molded to the outside of the base pan 26 and a sole plate 29 mounted to the underside thereto. The sole plate 29 comprises an aperture base for retaining the brush roll 68 in the base pan 26 and a rearwardly-extending flange which serves as a cover for vacuum motor drive belt 74. The sole plate 29 is mounted to the base pan 26 by forward projections 54 on the sole plate 29 and corresponding slots (not shown) in the base pan 26. As shown in FIG. 4 and in greater detail in FIG. 9, a flexible finger 56 extends upwardly from each lateral side of the sole plate 29 and is releasably received in a slot 58 and lockingly engages a downwardly-extending tab 57 having a rearwardly-extending flange 59 in the base pan 26. Each flexible finger 56 can be removed from engagement with the tab 57 by either inserting a user's finger or a tool such as a screwdriver into the slot 58 and urging the flexible finger 56 forwardly and the tab 57 rearwardly. This action causes the flange 59 on the tab 57 to be released from engagement with the flexible finger 56 for removal of the sole plate 29 from the base pan 26. Alternately, or in addition to the flexible finger 56, screws 60 receiver within sockets 61 can be used to secure the sole plate 29 to the base pan 26. The sole plate 29 further has a rectangular flange 148 projecting upwardly from one side of the front portion thereof.

The cover 24 and the base pan 26 are both made of injection-molded resilient plastic. The bumper 27 is made of an elastomeric material that adheres to the base pan 26 and the bond is enhanced by dado-type undercuts in each part which provide additional mechanical holding. As shown in FIGS. 4 and 6, the cover 24 has a lower edge 62 which abuts an upper edge 63 of the base pan 26. The cover 24 further has a number of depending tabs 150 which extend along the front and sides of the cover 24. The tabs 150 have a lateral flange 152. The tabs 150 fit within a recess 154 formed in the base pan 26 and the lateral flanges 152 of the tabs 150 fit within an indentation 156 in the elastomeric bumper 27. The base pan 26 is formed by an injection-molding process in which the recesses 154 are formed. The bumper 27 is then overmolded to the base pan 26 in a mold which includes a core positioned within the recess 154 provided with a flange which corresponds to the lateral flange 152 on the cover tab 150. After overmolding, the core is pulled out of the recess 154. The elastomeric bumper 27 yields to permit the flange of the core to be pulled through the recess 24 which permits the depending tabs 150 on the cover 24 to retain the bumper 27 against the base pan 26.

A conventional light 31 and lens 32 are provided on the front of the cover 24 for illuminating the area in front of the foot 14. The lens 32 includes a progressive series of Fresnel elements (not shown) on an interior surface to direct the emission from the light 31 toward the floor (not shown) in front of the vacuum cleaner 12.

Referring to FIG. 4, the handle assembly 16 comprises a handle base 36, a fill tube 38, a handle 40, a handle grip 42, a latch receptacle 44, a bag retainer 46, a latch handle 48, an access panel 50 and an attachment 52 which includes storage compartments for vacuum cleaner tools and a rearwardly-extending wrapping loop 158 for an electrical cord 201. The fill tube 38 comprises a rear housing portion 86 including a vertical conduit 88 beginning at an inlet port 160 and terminating at a laterally-extending outlet port 162. The fill tube 38 further includes a vertically-extending flange 164. As shown in FIGS. 6 and 6A, the handle base 36 includes upstanding walls 148 and a pair of rails 166 and 168 adapted to slidably receive flanges 167 and 169, respectively, on the fill tube 38 around the inlet port 160. Likewise, the latch receptacle 44 includes rails (not shown) through which the latch receptacle 44 is slidably attached to the upper portion of the fill tube 38. The bag retainer 46 includes several rearwardly-extending tabs 174 which snap-fit adjacent the outlet port 162 of the fill tube 38 and includes a forwardly extending bag flange 176 for mounting a conventional filter bag 178 within a chamber 180 formed by the interior surfaces of the handle base 36, fill tube 38, latch receptacle 44 and the access panel 50.

The handle 40 includes an upper cylindrically-shaped flange which mounts the handle grip 42 and is shaped to ergonomically and comfortably receive a user's hand for pushing the vacuum cleaner 12 during use. The base of the handle 40 includes an axial chamber 90 which receives the vertical flange 164 on the fill tube 38 to mount the handle 40. An aperture in the wrapping loop 158 is aligned with corresponding apertures in the attachment 52, handle 40 and fill tube 38. A single screw 172 is inserted into the aligned apertures and threaded into a socket 175 in the latch receptacle 44 mounted to the fill tube 38 to secure the handle 40 between the attachment 52 and the fill tube 38 and to secure the latch receptacle 44 to the fill tube 38.

As shown in the exploded view of FIG. 4 and in greater detail in FIG. 6, the above-described bag chamber 180 is adapted to support the conventional filter bag 178 which receives the dirt and debris picked up by the vacuum motor. The access panel 50 is provided on the front of the bag housing 18 which can be removed or pivotally opened relative to the bag housing 18 to provide access to the bag chamber 180 for changing the filter bag 178. The access panel 50 mounts the latch handle 48 which includes a pair of L-shaped flanges 182 with an integral spring 184 therebetween and lateral protrusions 186 at each and of the flanges 182. The lateral protrusions 186 on the latch handle 48 are pivotally received in loops 188 near the top edge of access panel 50 to rotatably mount the latch handle 48 to the access panel 50. The integral spring 184 comprises a resilient arm which extends rearwardly from the L-shaped flanges 182 and bears against a shelf 190 on the access panel 50 beneath the loops 188 to outwardly bias the latch handle 48. The access panel 50 has a pair of depending tabs 198 at the lower sides and a depending tab 199 at a front side which fit behind the upstanding walls 148 to retain the lower portion of the access panel 50 on the handle base 36. To latch the access panel 50 to the fill tube 38, the access panel 50 is rotated on the depending tabs 199 and the outer legs of the flanges 182 hook behind a pair of catch fingers 192 on the latch receptacle 44 mounted to the fill tube 38 against the bias of the integral spring 184 on the latch handle 48.

As seen in FIG. 6, access panel 50 has several radial ribs 194 extending outwardly from the center of the interior of the access panel 50. The ribs 194 are designed to suspend a convention filter bag 178 a short distance from the interior surface of access panel 50 to prevent the filter bag 178 from sealing to the interior surface of the housing during use. In addition, the ribs 194 include several slot portions 195 designed to channel air flow between the filter bag 178 and the interior surfaces of the bag chamber 180 toward a vent 196 on a side of the fill tube 38.

Figure 5:
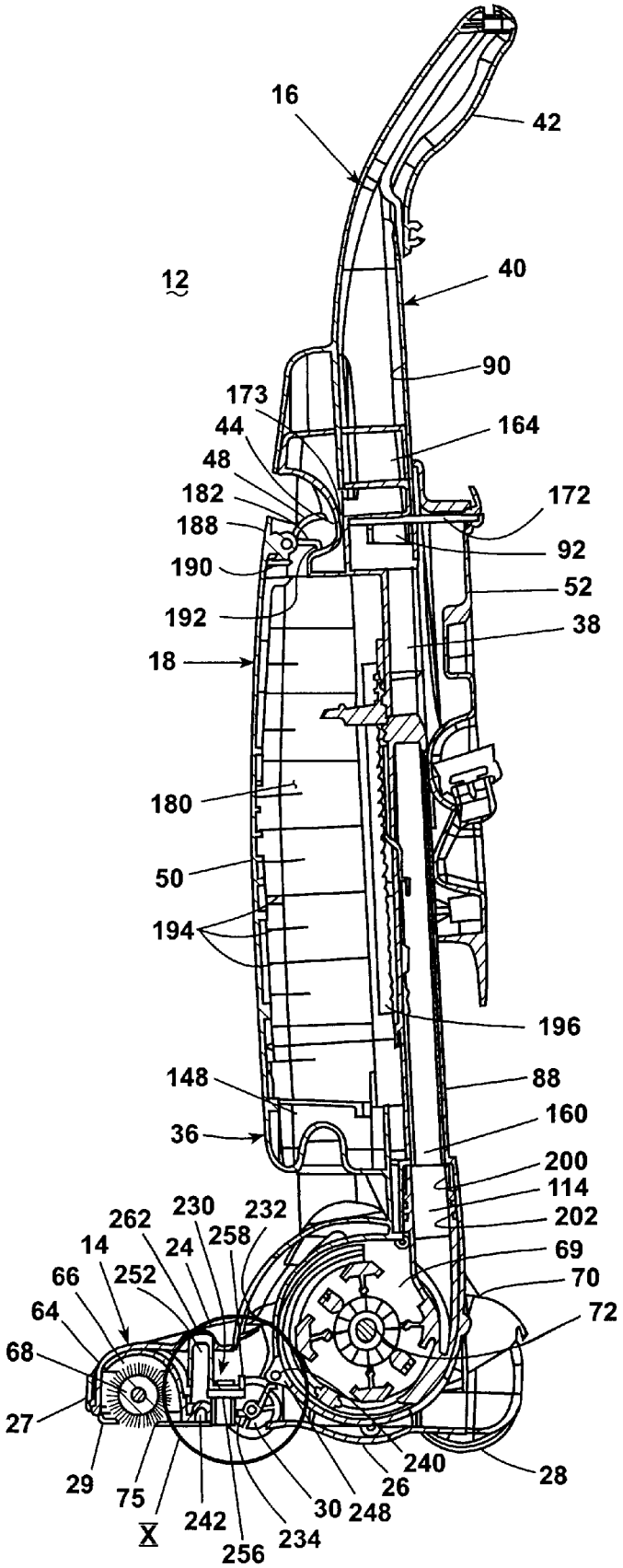
FIG. 5 is a cross-sectional view of the upright vacuum cleaner of FIGS. 1–4, taken along lines 5—5 of FIG. 3.
Figure 8:
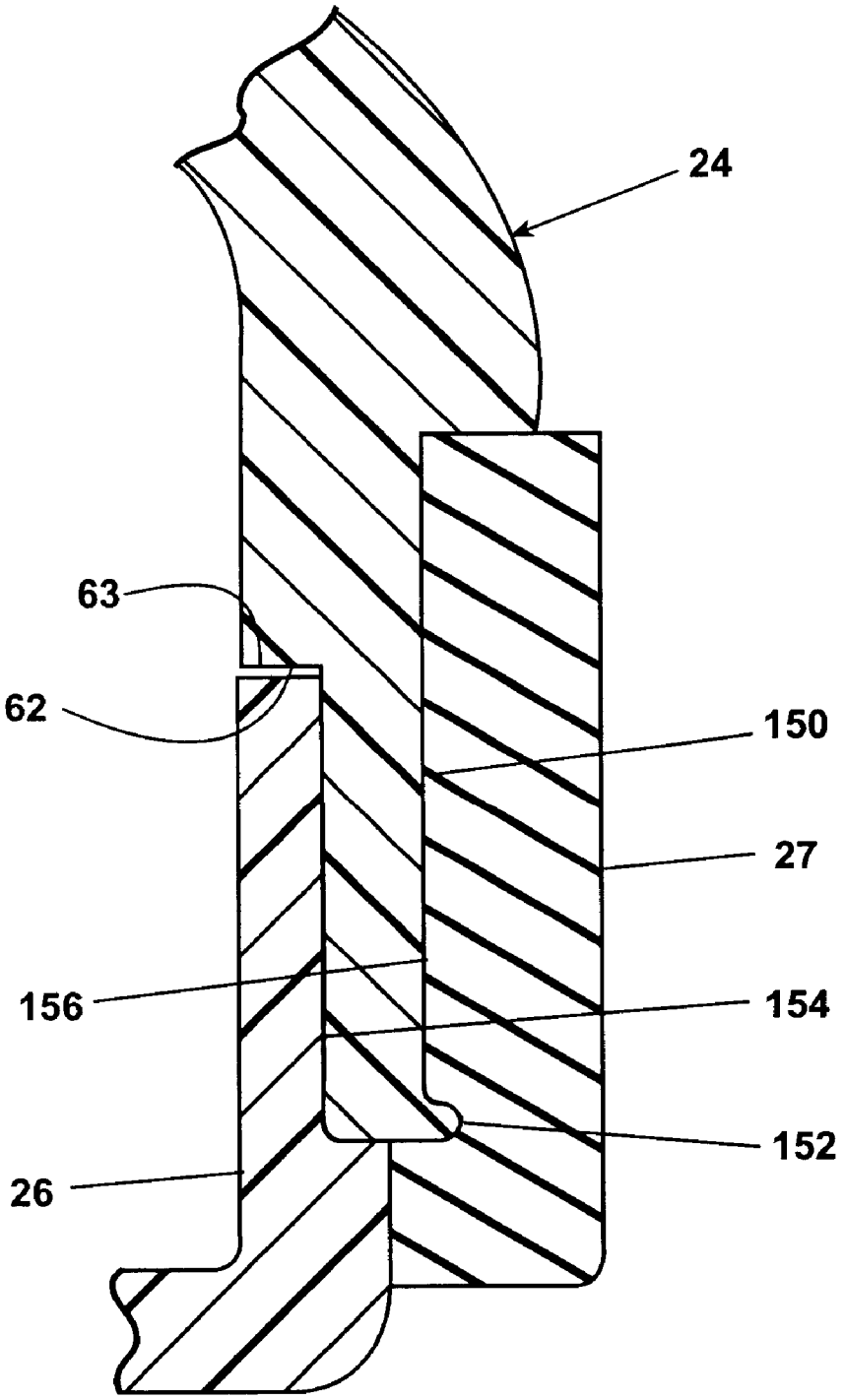
FIG. 8 is a fragmentary cross-sectional view of the vacuum cleaner of FIGS. 1–6, taken along lines 8—8 of FIG. 2.

Referring now to FIGS. 4 and 5, a vacuum motor 69 is provided inside a vacuum motor housing 70 which is rotatably mounted to the base pan 26. An upper surface of the vacuum motor housing 70 includes a pair of upwardly-extending rectangular flanges 71 and 73 disposed at a right angle with respect to each other and located adjacent a vacuum motor power toggle switch 218. A circular boss 108 extends from an impeller end 102 of the vacuum motor housing 70 and a second circular boss 146 extends from the other end of the vacuum motor housing 70. The boss 108 is inserted within an upwardly-extending circular retainer bracket 109 on the base pan 26 and the boss 146 is then urged downwardly and an end portion of the boss 146 is snapped into a slotted circular retainer bracket 147 extending upwardly from base pan 26. An inner portion of the boss 146, the circular bosses 108, 146 and retention brackets 109, 147 cooperate to pivotally secure the motor housing 70 to the base pan 26 as more fully disclosed in U.S. patent application Ser. No. 08/421,402 entitled Motor Mounting Arrangement and Method for a Vacuum Cleaner, filed Apr. 13, 1995, now U.S. Pat. No. 5,511,282, which is incorporated herein by reference. A downward-facing rib (not shown) on the cover 24 is positioned outwardly of the retainer bracket 147 to prevent the vacuum motor 69 from coming out of engagement with the retainer bracket 147 when the cover 24 is assembled onto the base pan 26.

As shown in FIGS. 4 and 5, an intermediate wall 64 of the base pan 26 forms a brush roll chamber 66 in which the brush roll 68 is rotatably mounted. A downwardly-facing brush roll opening 75 is provided in the brush roll chamber 66 for conventional on-the-floor cleaning. The brush roll 68 comprises a cylindrical body 130 having first and second bearings 132 and 133, respectively, at each end. Each bearing 132 and 133 includes an axially-extending projection 134 and 135, respectively. The cylindrical body 130 includes first and second axially-spaced transverse grooves 136 and 137 adjacent the second bearing 133 and has a crowned belt-receiving portion 138 between the grooves 136, 137. To assemble the brush roll 68 into the foot 14, a motor shaft 72 of the vacuum motor 69 extends from one end of the housing 70 and receives a brush roll belt 74. The belt 74 extends forwardly to capture the belt-receiving flange 138 of the brush roll 68 to rotatably drive the brush roll 68. The base pan 26 includes a first socket (not shown) into which the projection 134 on the bearing 132 is inserted. The projection 135 on the second bearing 133 is inserted into a vertical slot 140 in the base pan 26 and is retained therein by the bearing 148 on the sole plate 29 when the scale plate 29 is mounted to the base pan 26. The flanges 142 and 144 are semi-circular in configuration and form annular baffles in the drive belt 74. Similar semi-circular flanges are located on the base pan 26 in complementary relationship to the flanges 142 and 144. When the sole plate 29 is mounted to the base pan 26, the flanges 142 and 144 form annular baffles which are positioned in the first and second grooves 136 and 137 to prevent debris from entering the belt-receiving area 138. Preferably, the vacuum motor housing 70 and base pan 26 are designed such that the vacuum motor housing 70 rotates about the axis of rotation of the shaft 72 arid the bosses 108, 146 are concentrically aligned with the axis of the shaft 72.

An impeller fan 110 is operably coupled to the motor 69 and is in the impeller end 102 of housing 70. The impeller fan 110 is received in a conventional volute chamber 112 of the vacuum motor housing 70. The volute chamber 112 terminates in an outlet conduit 114 which is integrally formed with the vacuum motor housing 70 and extends outwardly therefrom and is provided with a smooth upper portion 200 and a lower ribbed portion 202. A resilient motor output gasket 204 is fitted over the smooth upper portion 200 of the outlet conduit 114. The output gasket 204 comprises an elastomeric rectangular band having several raised horizontal ribs 206 disposed around its perimeter. The output gasket 204 is snugly inserted over the smooth portion 200 of the outlet conduit 114 and is further matingly received within the inlet tube 160 of the fill tube 38 in order to provide a sealed fit between the outlet conduit 114 of the vacuum motor housing 70 and the fill tube 38. The outlet conduit 114 of the vacuum motor housing 70 is then securely mounted to the base portion of the fill tube 38 by a conventional fastener 208 to permit the handle assembly 16 to rotate with the motor housing 70, with respect to the base pan 26 about the axis of rotation of the motor shaft 72.

Figure 3:
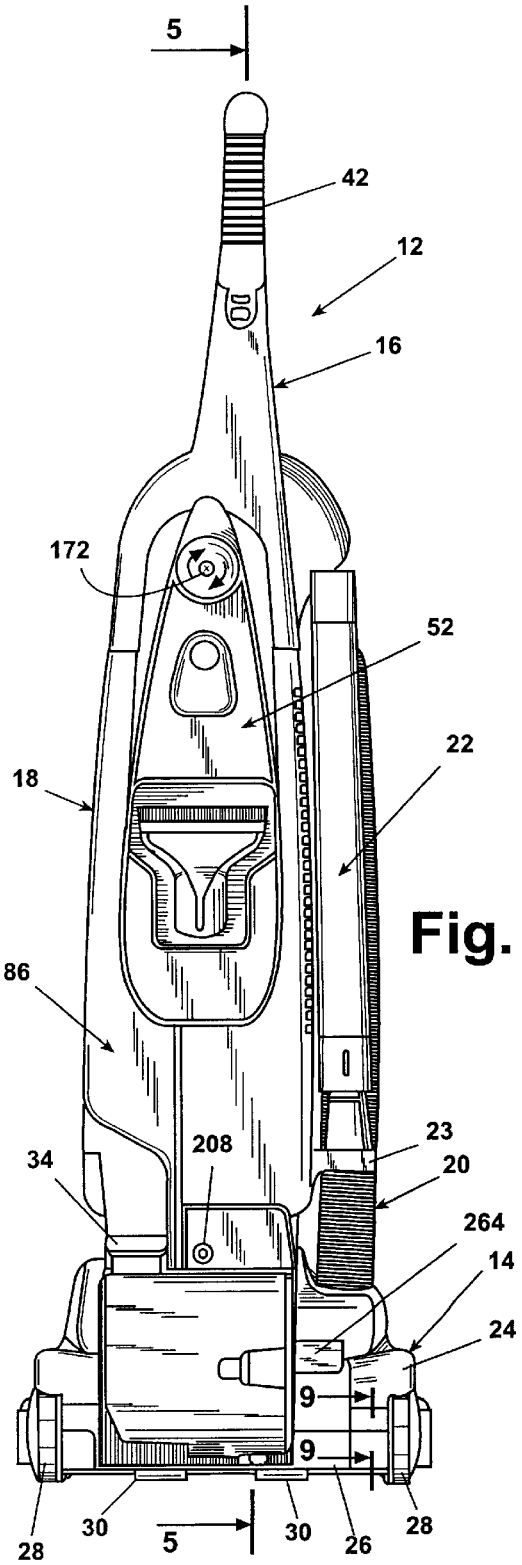
FIG. 3 is a rear elevational view of the upright vacuum cleaner of FIG. 1.

A foot pedal assembly 34 extends outwardly from tie rear of the foot 14 and is adapted to open and close the electrical circuit between a conventional source of electricity supplied by the electrical cord 201 and the vacuum motor 69. The foot pedal assembly 34 comprises a foot pedal 210 mounted over an optional spring 212 on a mounting at a lower portion of the fill tube 38. As shown in the enlarged perspective of FIG. 7, the underside of the foot pedal 210 is provided with laterally-extending pivot mounts 214 having elongated cross sections which pivotably mount to C-shaped mating sockets 220 in the lower portion of the fill tube 38. As shown in FIG. 3, the pivot mounts have flat sides and rounded ends so that they slide through the slots in the C-shaped mating sockets 220 and pivotably support the foot switch 34 therein. The underside of the foot pedal 210 further includes a vertically-extending U-shaped wall 211 and an outwardly-extending X-shaped flange 216 with rounded ends. The spring 212 is inserted over the flange 216 when the foot pedal 210 is installed onto the fill tube 38 such that the spring 212 upwardly biases the flange 216 of the foot pedal 210 against the toggle switch 218 on the vacuum cleaner motor 69. Alternatively, the spring 212 can be eliminated so that the flange 216 rests on the toggle switch 218 so that the bias of the toggle switch 218 returns the foot pedal 210 to its original position. To operate the vacuum cleaner motor 69, a user momentarily depresses the foot pedal 210 to force the flange 216 downwardly and depress the toggle switch 218. When the foot pedal 210 is urged downwardly a sufficient distance, the underside of the foot pedal 210 abuts the flanges 71 and 73 on the motor housing 70 which prevents overtravel and breakage of the foot pedal 210. In addition, the U-shaped wall 211 and the flanges 71 and 73 cooperate to prevent debris from entering adjacent the vacuum motor 69. As the foot pedal 210 is released, the upward bias of either spring 212 or the toggle switch 218 returns the toggle switch 218 to its normal undepressed position. Electrical energy is then supplied to the motor 69. The toggle switch 218 is operated in a similar manner to cut off the electrical energy to the motor 69.

A working air conduit 76 is formed in the base pan 26 by a bottom wall 78 and a pair of upstanding side walls 80 and 82. It is closed on the top by a cover plate 84 which mounts a diverter valve 94. The diverter valve 94 is sealed to the side walls 80 and 82 and the bottom wall 78 by a shoulder (not shown) which is in contact with the side walls 80 and 82 during movement of the handle assembly 16 between an upright position and a reclining position. The working air conduit 76 extends rearwardly from one end of the brush roll chamber 66 to the impeller fan opening 110 to fluidly connect the brush roll chamber 66 to the impeller fan 110. A flexible hose mount 100 is integrally formed in the cover plate 82 and mounts the lower end of the flexible hose 20. The hose mount 100 is in registry with hose opening 98 in cover 24. Conventional fasteners such as adhesives can be used to secure the lower end of the hose 20 to the mount 100.

As shown in FIG. 4, the convertible upright vacuum cleaner 12 according to the invention incorporates a conversion valve assembly 120, described in U.S. patent application Ser. No. 08/511,715 filed on Aug. 4, 1995, now U.S. Pat. No. 5,560,074, and incorporated herein by reference, to selectively direct the suction generated by the impeller fan between either the brush roll chamber 68 or the flexible hose 20 depending upon the position of the handle 16 relative to the foot 14. The diverter valve 94 is controlled by the handle 16 to shut off the low of air from the brush roll chamber 68 or the flexible hose in a manner described in U.S. Pat. No. 5,560,074. With the handle 16 received in the upright position as seen in FIG. 1 the diverter valve assembly 94 is pivoted to establish fluid flow communication between the flexible hose 20 and the volute chamber 112 and block fluid flow communication between the brush roll chamber 66 and the volute chamber 112. Therefore, all of the suction generated by the rotation of the impeller fan 110 is directed solely to the flexible hose 20 for above-the-floor cleaning when the handle assembly 16 is in the upright position as shown in FIG. 1.

Figure 10:
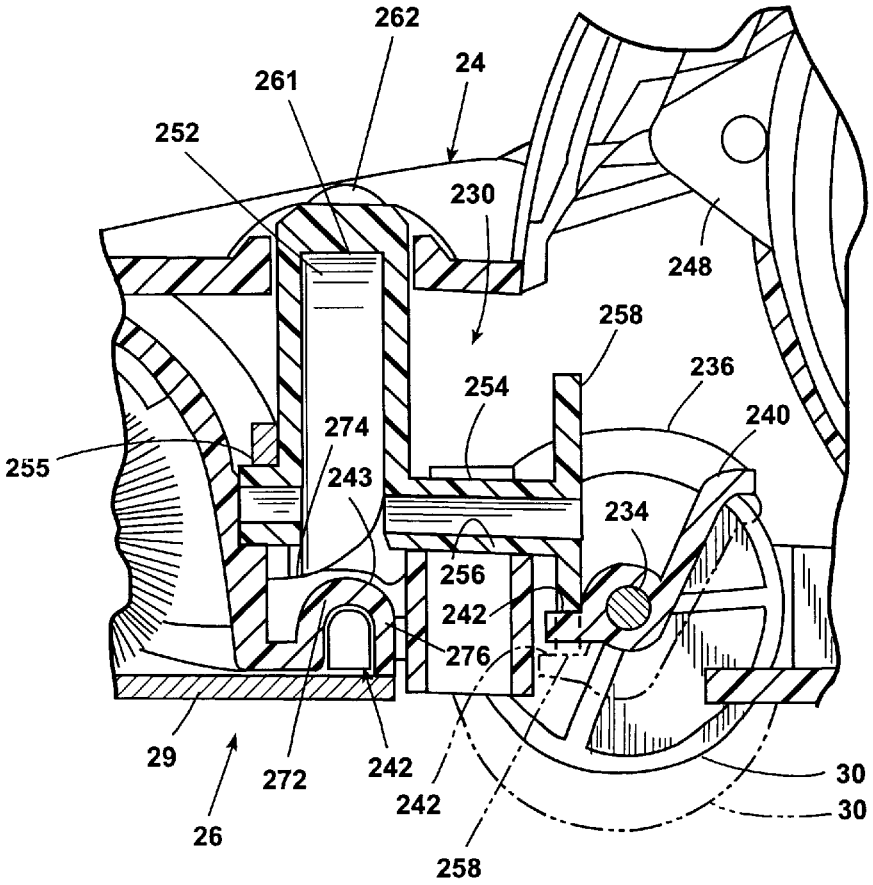
FIG. 10 shows cross-sectional view of the vacuum cleaner of FIGS. 1–6, enlarging the region marked 10 of FIG. 5.
Figure 11:
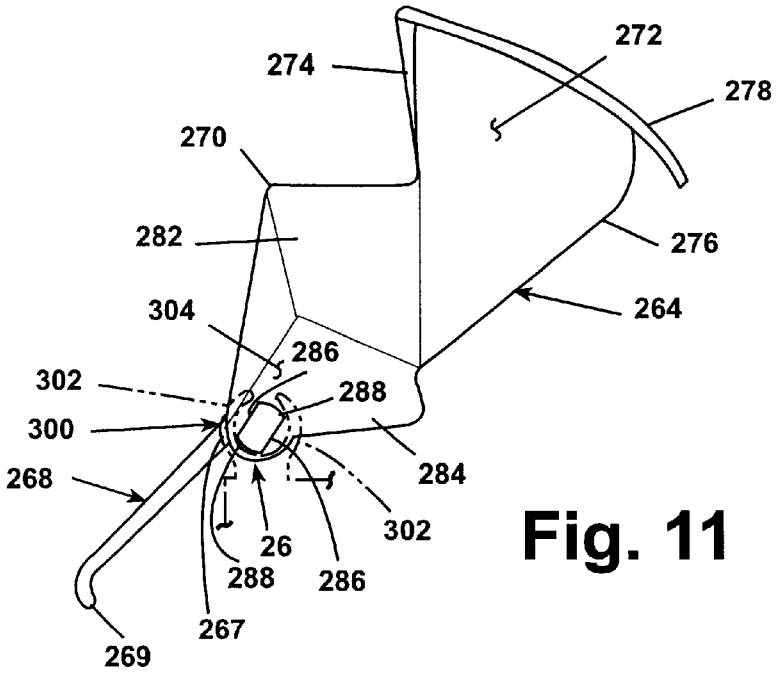
FIG. 11 is a side elevational view of a pedal for use in retaining a handle assembly on the upright vacuum cleaner in one of several positions according 0o the invention.

The upright vacuum cleaner 12 also includes a lift assembly 230 which automatically lifts the brush roll chamber 66 from contact with the floor being cleaned when the handle assembly 16 is pivoted from an angular use position shown in FIG. 10 to the upright storage position shown in FIG. 1.

Turning to FIGS. 4, 5 and 10, the lift assembly 230 comprises a housing 232, axle 234 and lift wheels 30. The housing 232 comprises a pair of semi-cylindrical shells 236 and 238 connected at a central portion by a flange 240. The housing 232 includes two pairs of forwardly-extending flanges 242 each having a transversely-oriented cylindrical retainer bracket 243 extending upwardly therefrom. The base pan 26 includes two pairs of inverted U-shaped mounts 272 extending upwardly from the base pan 26 adjacent the brush roll chamber 66 and mounted to the base pan 26 at a forward leg 274 and a rearward leg 276. The housing 232 is assembled to the base pan 26 by positioning the housing 232 in a vertical orientation adjacent the U-shaped mounts 272. The housing 232 is then slid transversely in order to slidably insert the bracket 243 of the flanges 242 into the interior of the U-shaped mounts 272 for pivotable movement of the housing 232 in the U-shaped mounts 272. Axle 234 is mounted to the housing 232 and rotatably mounts the lift wheels 30, each of which is disposed within a shell 236 and 238 such that the housing 232 can pivot the attached lift wheels 30 downwardly through corresponding apertures 244 and 246 in a central portion of the base pan 26. The pivotably-mounted motor housing 70 includes an outwardly-extending triangular protrusion 248 along its forward surface. As the vacuum cleaner handle assembly 16 is rotated from a lower position to an upright position as shown in FIG. 1, the outwardly-extending protrusion 248 on the surface of the rotating motor housing 70 contacts the wheel housing 232 at central flange 240 and forces the wheel housing 70 to pivot downwardly with respect to the base pan 26 to thereby raise the forward end of the foot 14 with respect to the floor surface in order to prevent contact between the brush roll 68 and the floor surface.

Again turning to FIGS. 4. 5 and 10, the upright vacuum cleaner 12 also includes a manual height adjustment mechanism 250 comprising a thumb wheel 252 mounted at a central portion thereof to a forward end of a shaft 254 which is journaled at 256 in the base pan 26 and includes a smooth, elliptical eccentrically-mounted cam 258 at a rearward end of the shaft 254. The thumb wheel 252 comprises a substantially semi-cylindrical shall having several detents 260 on a forward surface and several rounded detents on an outward radial surface 261 thereof. The journal mounting 256 comprises a upwardly-extending slotted circular retainer. A central portion of the shaft 254 snap-fits within the journal mounting 256 which supports the shaft 254 for rotation about a longitudinal axis of the shaft 254. Alternatively, or in addition to the journal mounting 256 the forward end of the shaft 254 can be cantilevered within a circular socket 255 within the base pan 26 to provide additional rotational support for the shaft 254. At the opposite end of the shaft 254, the cam 258 bears against the central flange 240 of the wheel housing 232. The detents 260 along the outer forward surface of the thumb wheel 252 mate with a resilient deflectable finger (not shown) mounted to the base pan 26 to hold the thumb wheel 252 in one of several adjustment positions. In its assembled state within the base pan 26, the rounded detents on the outer radial surface of the thumb wheel 252 protrude through an aperture 262 on the cover 24 for access to the height adjustment mechanism 250 by the user. Although the thumb wheel 252 can be rotated while the handle assembly 16 is in the upright position, actual pivotable movement of the wheel housing can only occur when the handle assembly 16 is lowered into an angular use position. As shown in FIG. 10, when the handle assembly is lowered into an angular use position, the triangular protrusion 248 on the motor housing 70 is rotated upwardly above the housing 232. The weight of the vacuum cleaner rests in part on the lift wheels 30 urging them upwardly against the lower edge of the cam 258. As the height adjustment wheel 252 is rotated by the operator, the eccentric mounting of the cam 258 on the thumb wheel 252 moves the lower edge of the cam 258 vertically with respect to the base pan 26 which, in turn, urges the housing 232 upwardly or downwardly as shown in the phantom outline of FIG. 10. In addition, the rotation of the thumb wheel 252 positions the deflectable finger (not shown) at the next successive detent 260 on the forward surface of the thumb wheel 252 to retain the lift wheels 30 at the new height.

As shown in FIGS. 2, 11, 12, and 13A–13C, the upright or lowered position of the handle assembly 16 is controlled by a foot pedal 264 which locks the handle assembly 16 in an upright position, releases the handle assembly 16 from movement to an angular use position, and then further releases the handle assembly 16 to permit rotation of the handle to a generally horizontal position. The foot pedal 264 comprises a body 272 having a forward surface 274 and a rearward surface 276. A sloped upper surface 278 is provided on the body 272 and extends between the forward and rearward surfaces 274 and 276, respectively. It will be understood that the slope of the upper surface 278 is configured to provide an ergonomic and comfortable surface for engagement by a user's foot, and any engagement surface can be substituted for the sloped upper surface 278 without departing from the scope of this invention.

The forward surface 274 of the body 272 is provided with a forwardly-extending flange 282 which defines a ridge 270 at an upper portion thereof.

A lower portion of the body 272, disposed between the flange 282 and the rearward surface 276, is provided with a pair of lower flanges 284 which extend downwardly from each lateral side of the body 272 and are interconnected by an axle 266. The axle 266 has a pair of parallel flat side surfaces 286 and a pair of arcuate surfaces, 288.

A proximal end 267 of a spring 268 is preferably mounted to at least one of the lower flanges 284 and preferably comprises an elongated arm extending from the lower flange 284 in a downward direction with respect to the body 272. The spring 268 is preferably formed from a resilient material, and preferably formed from the same material as the foot pedal 264 as a whole. A distal end 269 of the spring 268 can be provided with a curved portion thereon. The spring 268 has a longitudinal axis which can be generally aligned with an axis which connects the proximal end 267 of the spring 268 and the upper surface 272 of the foot pedal 264.

Figure 12:
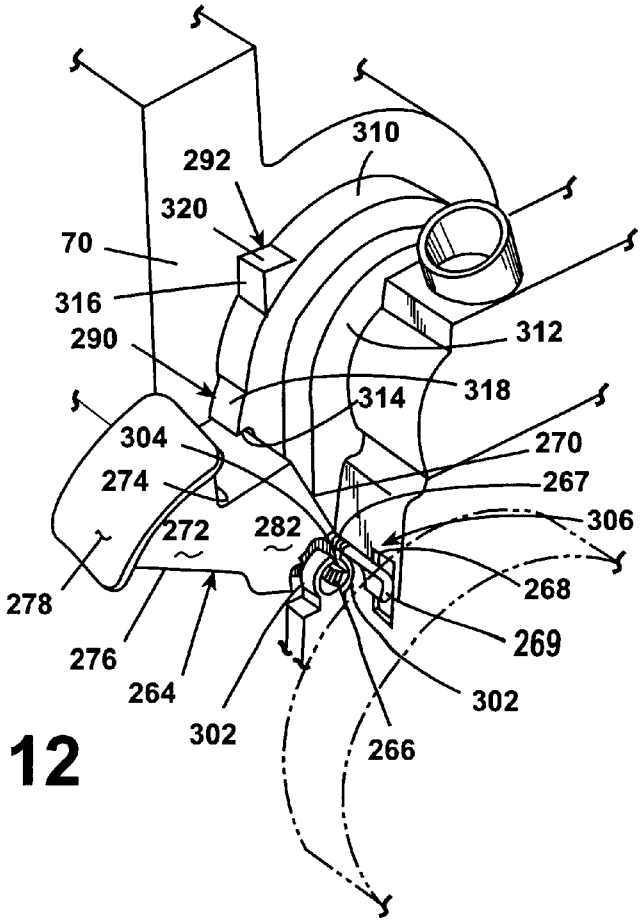
FIG. 12 is a fragmentary perspective view of the upright vacuum cleaner showing the mounting of the foot pedal of FIG. 11 to a base pan of the upright vacuum cleaner and showing the engagement of the foot pedal with protrusions located on a motor housing thereof.
Figure 13A:
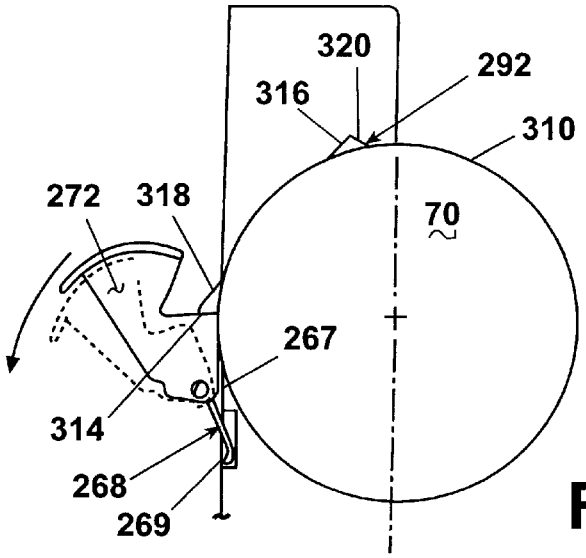
FIG. 13A is a schematic view showing the foot pedal of FIG. 11 retaining the handle assembly in an upright non-use position.
Figure 13B:
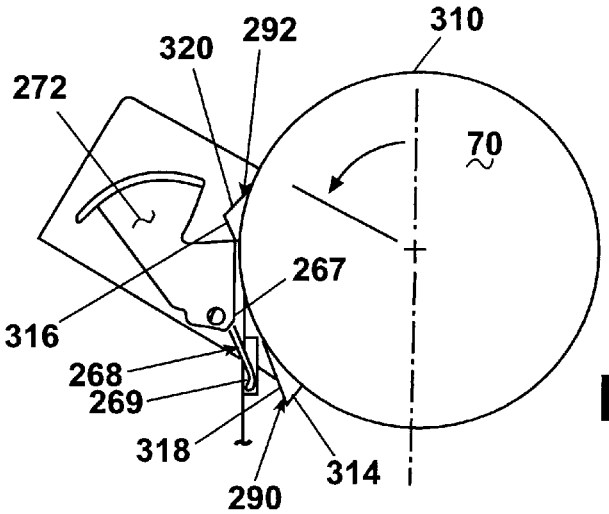
FIG. 13B is a schematic view showing the foot pedal of FIG. 11 retaining the handle assembly in an angular use position.
Figure 13C:
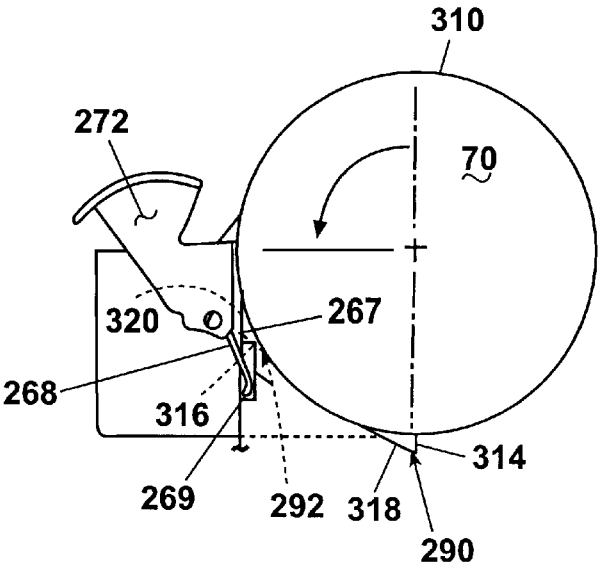
FIG. 13C is a schematic diagram showing the handle assembly rotated to a substantially horizontal use position according to the invention.

As shown in FIG. 12, the base pan 26 has a slotted circular retainer 300 defined by a pair of arcuate arms 302 mounted in cantilever fashion to the base pan 26 and having a gap 304 defined between distal ends thereof. The foot pedal 264 is pivotally mounted to the base pan 26 of the vacuum cleaner 12 by passing the axle 266 of the foot pedal 264 through the gap 304 within a slotted circular retainer 300. To this end the distance between the flat surfaces is slightly less than the width of the gap 304 so that the axle can easily slip through the gap 304. Rotation of the axle 266 after insertion through the gap 304, rotatably retains the axle 266 in the journal formed by arms 302.

As shown in FIG. 12, when the axle 266 of the foot pedal 264 is mounted within the retainer 300 of the base pan 26, the distal end 269 of the spring 268 is positioned within a recess 306 of the base pan 26 to bias the foot pedal 264 into an upright position. In the upright position, the ridge 270 of the forwardly-extending flange 282 abuts an annular ridge 310 extending laterally from the motor housing 70. Tile motor housing 70 further has an additional coaxial ridge (not shown) which is journaled within a pair of spaced bearings 312 on the base pan 26. As was previously described, the handle the handle assembly 16 is mounted to an upper portion of the motor housing 70 so that the handle assembly 16 can be rotated as a unitary extension of the motor housing 70.

The annular ridge 310 is provided with first and second triangular protrusions 290 and 292 in a circumferentially spaced relationship along the annular ridge 310. The protrusions 290 and 292 have leading edges 314 and 316, respectively, and trailing edges 318 and 320, respectively.

The ridge 270 of the foot pedal 264 is biased against the annular ridge 310 of the motor housing 70 by the abutment of the arm spring 268 within the recess 306 of the base pan 26. As the handle assembly 16 is moved rotationally, the ridge 270 of the foot pedal 264 rides against the annular ridge 310 of the motor housing 70. In the upright, non-use position, the ridge 270 is preferably urged against the annular ridge 310 of the motor housing 70 and prevented from rearward rotational movement by the engagement of the leading edge 314 of the first protrusion 290 thereagainst. To move the handle to the angular, use position, a user can rotate the foot pedal 264 rearwardly, preferably by engagement of the user's foot against the upper surface 278 thereof, so that the ridge 270 is pivoted rearwardly against the bias of the spring 268 a sufficient distance so that the first protrusion 290 can be pivoted with the handle assembly 16 past the ridge 270. Once sufficient clearance is provided by the rearward rotation of the foot pedal 264, the leading edge 314 of the first protrusion 290 can be pivoted past the ridge 270 of the foot pedal 264. The foot pedal 264 is released whereby the spring 268 returns the ridge 270 of the foot pedal 264 into engagement with the annular ridge 310 of the motor housing 70. The ridge 270 can ride against the trailing edge 318 of the first protrusion 290 as the handle assembly 16 is pivoted rearwardly. The angular, use position is preferably reached when the ridge 270 of the foot pedal 264 encounters the leading edge 316 of the second protrusion 292. An additional actuation of the foot pedal 264 allows the handle assembly 16 to be rotated past the leading edge 316 of the second protrusion 292, along the trailing edge 320 thereof to a fully lowered position.

The handle assembly 16 can also be moved from the upright, non-use position to the angular use and fully lowered positions without actuation of the foot pedal 264. Merely urging the handle assembly 16 in a downwardly rotational manner causes the ridge 270 to cam, in succession, against the leading edges 314 and 316 of the first and second protrusions 290 and 292, respectively. A camming action is created by the forced engagement of the ridge 270 of the foot pedal 264 against the protrusions 290 and 292 which causes the handle to be lowered without intentional actuation of the foot pedal 264. This "override" feature prevents breakage of the foot pedal 264 as a result of excessive rotational forces applied to the handle assembly 16.

It will be understood that the angular relationship of the leading edges 314 and 316 of the first and second protrusions 290 and 292, respectively, can be independently selected to predetermine the amount of rotational force that must be applied to the handle assembly 16 to override the normal operation of the foot pedal 264. For example, it has been found that providing the first protrusion 290 with a generally normal angular relationship with respect to the annular ridge 310 of the motor housing 70 creates a "hard" detent for which overriding the foot pedal 264 thereagainst is difficult. In addition, it has also been found that it is preferable to provide the leading edge 316 of the second protrusion 292 with an obtuse angular relationship with respect to the annular ridge 310 of the motor housing 70 so that overriding the foot pedal 264 thereagainst is easier than the above-described configuration of the leading edge 314 of the first protrusion 290. Thus, the second protrusion 292 is preferably a "soft" detent which has a gently-slopped leading edge 316, such as a substantially isosceles triangular shape.

The first protrusion 290 preferably retains the handle assembly 16 in a substantially vertical position, preferably about 5° forward of vertical and requires either actuation of the foot pedal 264 or a very large override force in lieu of actuation of the foot pedal 264, to release the handle assembly 16 for rotation. The second protrusion 292 retains the handle assembly 16 at approximately 45° rearward of vertical and requires either actuation of the foot pedal 264 or a lesser manual downward pressure exerted on either the nozzle 14 or the handle assembly 16 to release the handle assembly 16 for further downward rotation to a horizontal position.

When the handle assembly 16 is to be rotated by release of the foot pedal 264 from engagement with the motor housing 70, the foot pedal 264 is momentarily depressed which rotates it away from the motor housing 70 to release the ridge 270 on the foot pedal 264 from contact with the first protrusion 290 on the annular ridge 310 of the motor housing 70. The handle assembly 16 can then be freely rotated to a position defined by the second protrusion 292. When the foot pedal is released, the arm spring 268 urges the ridge 270 back into contact with the annular ridge 310 and/or the protrusions 290 and 292 of the motor housing 70.

In operation, the handle assembly 16 on the upright vacuum cleaner 12 can be placed into a floor cleaning use position by actuating foot pedal 264 and lowering the handle assembly 16 into an approximate 45-degree position. The vacuum motor 69 can be actuated by momentarily depressing foot switch 34 allowing the vacuum cleaner 12 to be rolled over the floor surface to be cleaned. Depending upon the type of floor surface being cleaned, the thumb wheel 252 of the height adjustment mechanism 250 can be rotated clockwise or counterclockwise to raise or lower the housing 232 and, consequently, the foot 14 is repositioned at a particular desired height for optimal cleaning effectiveness. Once the foot switch 34 is actuated which supplies power to the motor 69, the brush roll 68 is rotated at a high speed through the transmission of the rotation of the motor shaft 72 through the belt 74. Dust and other debris is loosened by the brush roll 68 and suctioned into the working air conduit 76, expelled out of the outlet conduit 114, and into the vertical conduit in the till tube 38 such that it is trapped in the filter bag 178 in the bag chamber 180. Alternatively, the hose 20 can be used to collect dust and debris when the handle assembly 16 is in the upright position as the conversion valve assembly 120 diverts the suction through the hose 20. When finished, the handle assembly 16 can be repositioned in the upright position as shown in FIG. 1 which automatically lifts the foot 14 from contact with the floor via lift mechanism 230 and turned off by again momentarily depressing foot switch 34.

On occasion, the vacuum motor drive belt 74 wears thin and requires replacement. When it is desired to replace the belt 74, the sole plate 29 can be removed, which exposes an axially-extending channel 280 in the base pan 26 into which extends the motor shaft 72 and the drive belt 74 which extends forwardly to its mounting to the brush roll 68. The sole plate 29 can be removed by manually disengaging each flexible finger 56 from engagement with the tabs 57 on the base pan 26 as discussed earlier in this application. The brush roll 68 is rotatably mounted within a brush roll chamber 66 within the base pan 26 and is retained at one end by a circular aperture in the base and at another end by a bearing projection on the sole plate 29. The sole plate 29 has a flexible finger 56 with a retainer which snaps into an opening in the base pan 26. The belt 74 passes around the shaft 72 of the motor 69 and around a groove on the brush roll 68 such that rotation of the shaft 72 causes the belt 74 to impart rotary motion upon the brush roll 68. The removal of the sole plate 29 from the base pan 26 reveals the wide channel 280 along the longitudinal path of the vacuum motor drive belt 74 such that the channel 280 provides easy access for removal and replacement of the drive belt 74. To replace the belt 74, the brush roll 68 is removed from the brush roll chamber 66 in the base pan 26 and a new belt can be slipped over the shaft 72 in the channel 280 and over the belt-receiving area 138 of the brush roll 68. The brush roll 68 can then be moved forward into the brush roll chamber 66 in the base pan 26 which stretches the belt 74 as it moves and provides the proper tension in the belt. The sole plate 29 is then remounted on the base pan 26 to retain the brush roll 68 and permit the rearwardly-extending flange on the sole plate 29 to re-cover the belt 74 in the channel 280.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. A vacuum cleaner comprising:

a foot;

a handle pivotally mounted to the foot;

a locking assembly for releasably locking the handle in an upright position, the locking assembly including a foot pedal pivotally mounted to the base for movement between a locked position and an unlocked position and having one of a protrusion and a recess and the handle having the other of the protrusion and the recess for selectively locking the handle in the upright position, the foot pedal having an upper surface for actuation by a user, an axle through which the foot pedal is pivotally mounted to the base, and a spring with a proximal end integral with the foot pedal and having a distal end bearing against the base for biasing the foot pedal into the locking position;

the improvement comprising:

the proximal end of the spring is mounted adjacent the axle.

2. The vacuum cleaner of claim 1 wherein the base has a slotted circular retainer including a gap between a pair of arcuate arms for mounting the axle and the axle has a pair of flat surfaces adapted to fit through the gap for mounting the axle to the circular retainer.

3. The vacuum cleaner of claim 2 wherein the axle further comprises a pair of arcuate surfaces connecting the flat surfaces for journaling the axle within the slotted circular retainer.

4. The vacuum cleaner of claim 3 wherein the spring has a longitudinal axis which is generally aligned with an axis between the axis of rotation of the axle and the upper surface of the foot pedal.

5. The vacuum cleaner of claim 4 wherein the foot pedal is integrally molded in one piece.

6. The vacuum cleaner of claim 5 wherein the foot pedal further comprises a pair of side walls and the axle extends between the side walls.

7. The vacuum cleaner of claim 6 wherein the side walls each have an exterior surface and the spring is mounted to the exterior surface of one of the side walls.

8. The vacuum cleaner of claim 1 wherein the foot pedal is integrally molded in one piece.

9. The vacuum cleaner of claim 1 wherein the foot pedal further comprises a pair of side walls and the axle extends between the side walls.

10. The vacuum cleaner of claim 9 wherein the side walls each have an exterior surface and the spring is mounted to the exterior surface of one of the side walls.

11. A vacuum cleaner comprising:

a foot;

a handle pivotally mounted to the foot;

a locking assembly for releasably locking the handle in an upright position, the locking assembly including a foot pedal pivotally mounted to the base for movement between a locked position and an unlocked position and having one of a protrusion and a recess and the handle having the other of the protrusion and the recess for selectively locking the handle in the upright position, the foot pedal having an upper surface for actuation by a user, an axle through which the foot pedal is pivotally mounted to the base, and a spring with a proximal end integral with the foot pedal and having a distal end bearing against the base for biasing the foot pedal into the locking position;

the improvement comprises:

the base has a slotted circular retainer including a gap between a pair of arcuate arms for mounting the axle and the axle has a pair of flat surfaces adapted to fit through the gap for mounting the axle to the circular retainer.

12. The vacuum cleaner of claim 11 wherein the axle further comprises a pair of arcuate surfaces connecting the flat surfaces for journaling the axle within the slotted circular retainer.

13. The vacuum cleaner of claim 12 wherein the foot pedal is integrally molded in one piece.

14. The vacuum cleaner of claim 13 wherein the foot pedal further comprises a pair of side walls and the axle extends between the side walls.

15. The vacuum cleaner of claim 14 wherein the side walls each have an exterior surface and the spring is mounted to the exterior surface of one of the side walls.

16. The vacuum cleaner of claim 11 wherein the foot pedal is integrally molded in one piece.

17. The vacuum cleaner of claim 11 wherein the foot pedal further comprises a pair of side walls and the axle extends between the side walls.

18. The vacuum cleaner of claim 17 wherein the side walls each have an exterior surface and the spring is mounted to the exterior surface of one of the side walls.

* * * * *